United States Patent [19]

Gonzalez

[11] Patent Number: 4,476,884

[45] Date of Patent: Oct. 16, 1984

[54] ROTARY PAYOUT DEVICE FOR RECREATIONAL MACHINES

[76] Inventor: Pedro A. Gonzalez, Rius Carrió, 33, Hospitalet de Llobregat (Barcelona), Spain

[21] Appl. No.: 440,851

[22] Filed: Nov. 12, 1982

[30] Foreign Application Priority Data

Nov. 18, 1981 [ES] Spain ..... 261.942[U]

[51] Int. Cl.[3] ..... G07D 9/04

[52] U.S. Cl. ..... 133/4 A

[58] Field of Search ..... 133/4 R, 4 A, 8 C, 3 E, 133/3 H, 1 R, 2, 3 A, 3 B, 3 C, 5 R; 198/396, 397, 343, 344

[56] References Cited

U.S. PATENT DOCUMENTS 1,655,412 1/1928 Donnellan ..... 133/3 E

*Primary Examiner*—Stanley H. Tollberg

*Attorney, Agent, or Firm*—James & Franklin

[57] ABSTRACT

A rotary payout device for recreational machines comprises a cover, a disk and a casing. The cover and casing are held together by six springs in contact with the undersides of the screw heads and the cover, making the joint between casing and the cover flexible.

4 Claims, 2 Drawing Figures

ROTARY PAYOUT DEVICE FOR RECREATIONAL MACHINES

DESCRIPTION

Figure 1:
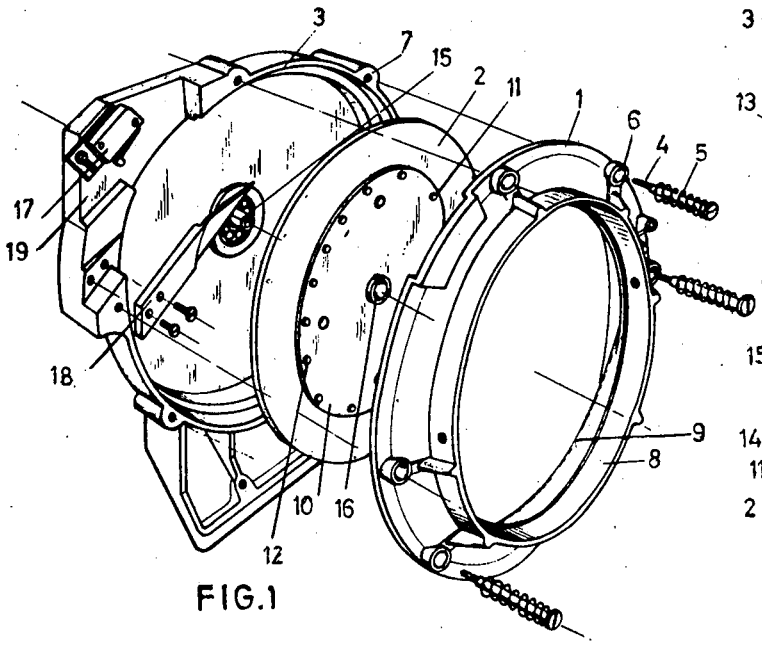

The present Patent refers to a rotary payout device specially designed for application in recreational machines.

The invented device hereby claimed will be installed in the type of recreational machines which are made to function by inserting a coin and which contain a fairly complex mechanism which makes it possible when a coin is inserted to obtain various prizes according to the combination formed inside the machine.

In machines of this type, the coins inserted drop into a container which acts as a store, and the described rotary payout device is designed to act as the bottom of the said container when it is installed, on which bottom the coins are deposited as they are fed into the machine by the successive players, the essential functions which the payout device constituting this invention must perform being the following:

(a) Ensuring that the coins are deposited evenly without jamming.

(b) Permitting release of the necessary number of coins according to the prize won.

(c) Even if the accumulation of coins should result in a jam, providing the elements necessary for the jam to clear by itself without need of external action.

To this end, the rotary payout device to which this invention refers will be actuated electrically by pulses emitted by the machine according to the combinations which result or in function of the set of prizes which the game that can be played with the machine offers.

These pulses will cause the moving part of the payout device to function, for which purpose a motor with reduction gear will be necessary, plus a pulse counter relay which monitors the number of pulses delivered by the machine and ensures that the number of coins issuing from the payout device as the moving part turns is exactly the number desired.

The payout device properly speaking consists of three essential parts: a cover, a disk and a casing.

The cover and the casing are joined together and contain the disk. The cover and casing are held together by spring-loaded screws, which while securing them sufficiently allow a slight motion to occur whenever a chance jam of coins occurs whereby coins are retained between the casing and the cover, the force exerted by the coin as it is pushed by the ones following it being sufficient to lift the cover off the casing and allow the coin to drop, thus eliminating the difficulty.

The basic element of the invention is the disk fitted inside the payout device. It is mounted on a shaft connecting it to the motor and reduction gear, and has around its edge a number os small pivots, which are spaced apart by a distance equal to the diameter of the coin being played. In addition, there are four holes in the disk more to the centre in relation to these pivots, in which holes are fitted other pivots much larger in size, one cylindrical and the rest tapered, whose function is to guide the coins and make them issue evenly. Assisting this function is a nut projecting from the centre of the disk, which will tend to guide the coins toward the edge of the disk.

Mounted on the casing in front of the said disk is a small guide blade, which will catch the coins at the end of their travel over the disk and guide them toward the outside of the rotary payout device.

Turning to the cover, this is generally circular in shape, which facilitates its mounting on the casing, and has an opening at the centre into which will be fitted the storage container for the coins. An area of the inner lateral surface of the cover is generously curved to provide further guidance for the coins so that they will issue in uniform order.

From the foregoing description are apparent the basic features of the rotary payout device to which this invention refers, together with the advantages that installation thereof will contribute to recreational machines of this kind.

To facilitate explanation, this description is accompanied by a sheet of drawings on which is shown, by way of illustrative but not restrictive example, a case of a rotary payout device for recreational machines built according to the principles expressed in the claims.

Figure 2:
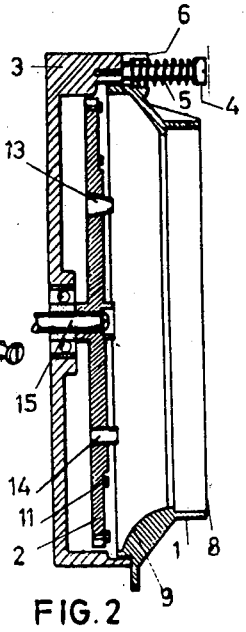

In these drawings:

FIG. 1 is a perspective view of the rotary payout device for recreational machines, while FIG. 2 is a sectional elevation of the fully assembled rotary payout device.

As can be seen from the said sheet of drawings, the payout device to which this invention refers consists of three basic elements, namely: the cover 1, the disk 2 and the casing 3, with the cover and casing held together by six screws 4, each loaded by a spring 5. The screws pass through holes 6 in the cover 1 and fit into blank holes 7 in the casing 3. This method of fastening and locking makes the joint between the two elements flexible.

The cover 1 properly speaking is circular in shape and has an opening 8 at the centre corresponding to the machine's coin storage container, with an area 9 of its inner surface generously curved to help prevent the coins from jamming inside the payout device.

The disk 2 has an inner concentric disk 10 around whose edge are a number of pivots 11 spaced evenly apart at a distance equal to the diameter of the coin used to operate these machines, with other holes 12 in areas close to the centre, in which are fitted projections 13 and 14 larger than the ones previously mentioned, some tapered and others cylindrical. At the centre of the disk, through which passes the shaft 15 connecting it with the motor and reduction gear, is a projection 16 which likewise helps to guide the coins toward the edge of the disk. The disk is precisely positioned and able to rotate inside the casing 3. On the casing is mounted a pulse counter relay 17 and a knife-like guide 18 which brushes the front face of the disk and guides the coins out through a slot 19 cut out between the casing 3 and the cover 1.

The numbers used in the above description are employed to facilitate description of the operation of the payout device to which this invention refers.

The coins which fall into the machine pile up on the disk 2. If the player obtains a combination for which the machine offers a prize, which can vary in amount, the machine so informs the payout device by electrical pulses whose number varies according to the amount of the prize. These pulses start a motor reduction gear and are monitored by the relay 17.

When the motor reduction gear starts to run, it makes the shaft 15 turn, and with it the disk 2. Between the pivots 11 on the disk lie the coins, which rotate with the disk without jamming, due to the existence of the curve 9 of the cover 1 and to the separation of the coins made possible by the two different types of pivot 13 and 14 plus the projection 16 at the centre.

Should a jam occur for any reason, and even if a coin is caught between the casing 3 and the cover 1, the mechanical flexibility between the two afforded by the springs 5 will allow the coin to drop and prevent jamming.

After the coins have been completely ordered and guided by the disk, they encounter the guide blade 18, which forces them out. The disk will be obliged to advance a number of times equal to the number of coins to be given as prize; after it has allowed that number of coins to escape through 19, the relay 17 will stop the motor and reduction gear, and the payout device will stop running until a similar situation recurs.

Any item which does not affect, alter, change or modify the essence of the rotary payout device as described will be variable for purposes of the present Patent.

I claim:

1. Rotary payout device for recreational machines, characterized by the fact that it comprises a cover, a disk and a casing, the cover and casing being held together by six spring-loaded screws, with the springs in contact with the under sides of the screw heads and the cover, making the joint between casing and cover flexible.

2. Rotary payout device for recreational machines as in claim 1, characterized by the fact that the cover has a wide circular opening at the centre allowing it to be fitted at the bottom of the machine's container for storing coins, an area of the inner peripheral surface of the cover being generously curved to assist in preventing the coins from jamming.

3. Rotary payout device for recreational machines as in claim 1, characterized by the fact that the concentric and also circular inner area of the disk is slightly raised, and that around this area are positioned a number of projecting pivots spaced apart by a distance equal to the diameter of the coins used to play, with another set of pivots, fewer in number than the ones referred to above, arranged in a circle of lesser diameter than that of those pivots, one of the second set of pivots being cylindrical and the remainder tapered and all being larger than the pivots of the first set, the second set of pivots being intended to facilitate separation of the coins; at the centre of the disk, around the shaft which is driven by a motor reduction gear and causes the disk to turn, is also a small projection whose purpose is the same.

4. Rotary payout device for recreational machines as in claim 1, characterized by the fact that there is a pulse monitor relay on the casing, together with a guide blade mounted on the front of the disk at a point which allows it to guide the coins out through a small notch between the cover and the casing, through which they leave the machine.

* * * * *